US007621617B2

(12) United States Patent
Arakawa

(10) Patent No.: US 7,621,617 B2
(45) Date of Patent: Nov. 24, 2009

(54) INK DROPLET DETECTION APPARATUS

(75) Inventor: Hiroaki Arakawa, Uenohara (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 11/408,262

(22) Filed: Apr. 20, 2006

(65) Prior Publication Data

US 2006/0256153 A1 Nov. 16, 2006

(30) Foreign Application Priority Data

Apr. 27, 2005 (JP) ..... 2005-130618

(51) Int. Cl.
*B41J 29/393* (2006.01)

(52) U.S. Cl. ..... 347/19; 347/5; 347/9

(58) Field of Classification Search ..... 347/19, 347/5, 9, 12, 15, 14
See application file for complete search history.

(56) References Cited

U.S. PATENT DOCUMENTS

2003/0090534 A1* 5/2003 Valero et al. ..... 347/19
2003/0132981 A1* 7/2003 Arakawa et al. ..... 347/19

FOREIGN PATENT DOCUMENTS

JP 10-119307 A 5/1998

* cited by examiner

*Primary Examiner*—Lam S Nguyen
(74) *Attorney, Agent, or Firm*—Frishauf, Holtz, Goodman & Chick, P.C.

(57) ABSTRACT

An ink droplet detection apparatus containing: a plurality of nozzle lines each containing multiple nozzles which eject ink droplets; a beam radiator for radiating a detection beam so as to cross a path of the ink droplets and forming a light path of the detection beam so as to be along two or more the nozzle lines being detected; two or more beam receivers corresponding to the nozzle lines being detected for receiving the beam radiated from the beam radiator and detecting a droplet ejected from the nozzle by determining whether the ink droplet ejected from each nozzle intercepts the light path or not; an ejecting control circuit for controlling the nozzles so as that the ink droplets are ejected from each nozzle; and a controller for controlling the ejecting control circuit by sending the ejecting control circuit the same ejecting start signals for each nozzle lines being detected so as that the ejecting timing of the ink droplets to be ejected from each nozzle of the plurality of the nozzle lines being detected is synchronized.

8 Claims, 6 Drawing Sheets

INK DROPLET DETECTION APPARATUS

TECHNICAL FIELD

This invention relates to an ink droplet detection apparatus, and more specifically relates to an ink droplet detection apparatus in which line detection can be performed at low cost, and the time for detecting non-jetting can be significantly reduced.

BACKGROUND

There is a technology in which non-jetting of a nozzle is detected by determining the shading which the ink droplets jet at a light receiving element, on a light path comprising a light emitting element and a light receiving element (for example Official Gazette of Japanese Patent Tokkai H10-119307).

In the technology describe in the Official Gazette of Japanese Patent Tokkai H10-119307, in the case where the number of nozzles on the head is increased, in detection of the ink droplets jetted from the nozzle positioned away from the light receiving element, output amplitude is reduced due to light diffraction, and detection is difficult due to S/N deterioration. In order to solve these problems, two sets of light emitting elements and light receiving elements are provided and placed such that the directions of radiation of the detection beam from the light emitting elements are opposite to each other, and detection accuracy is maintained by receiving such that the nozzles of the respective ink jet heads are divided in a front half and a rear half.

Meanwhile, in recent years, there has been demand for development of technology which realizes a method which is simple and low in cost, for detecting non-jetting nozzles in a plurality of nozzle lines such as in line heads.

However, there is absolutely no disclosure of non-jetting detection for a plurality of nozzle lines in the Official Gazette of Japanese Patent Tokkai H10-119307.

In the case where there are multiple nozzle lines such as in a line head, providing multiple light paths and performing detection in the lines can be considered. In this case, in order to perform detection of non-jetting nozzles, each nozzle line is independently detected and a jetting control structure is necessary.

A CPU is often used for jetting control of each nozzle line and for detection of non-jetting nozzles, and in some cases multiple CPUs are needed and this has the disadvantage of increased cost.

In addition, forming each nozzle line based on formation of the voltage waveform which is applied to the head causes the circuits in the jetting control circuit section to be complex and increases the circuit scale and jetting control is therefore difficult.

Furthermore, because the detectors are arranged in lines, detection time is made faster only not in the area of the detector, and this is a problem in that it causes circuits in the jetting circuit control section to be increased.

The problem in this invention is to provide an ink droplet detecting device in which parallel detection can be performed at low cost, and the time for detecting non-jetting can be significantly reduced.

SUMMARY

It is therefore an object of the present invention to provide an improved a ink droplet detection apparatus containing:

a plurality of nozzle lines each containing multiple nozzles which eject ink droplets a beam radiator for radiating a detection beam so as to cross a path of the ink droplets and forming a light path of the detection beam so as to be along two or more the nozzle lines being detected;

two or more beam receivers corresponding to the nozzle lines being detected for receiving the beam radiated from the beam radiator and detecting a droplet ejected from the nozzle by determining whether the ink droplet ejected from each nozzle intercepts the light path or not;

an ejecting control circuit for controlling the nozzles so as that the ink droplets are ejected from each nozzle;

a controller for controlling the ejecting control circuit by sending the ejecting control circuit the same ejecting start signals for each nozzle lines being detected so as that the ejecting timing of the ink droplets to be ejected from each nozzle of the plurality of the nozzle lines being detected is synchronized.

DESCRIPTION OF THE PREFERRED EMBODIMENT

Figure 1:
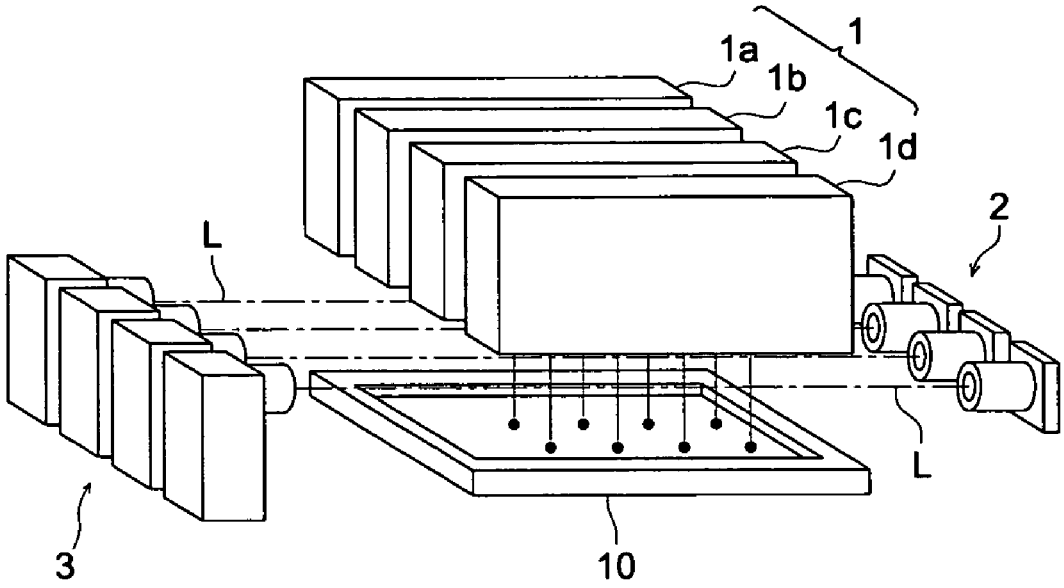
FIG. 1 is a perspective view of an example of the ink droplet detection means.

Other problems and effects of this invention will be described in the following.

The above problems are solved by the following inventions.

(1) An ink droplet detection device in which ink droplets are detected by disposing detection beams that are formed between the beam radiating means and the beam receiving means so as to cross the advance path of the ink droplets and correspond with multiple nozzle lines comprising multiple nozzles which jet ink droplets, and by determining the shading of the ink droplets that are sequentially jetted from each nozzle using the beam receiving means, said ink droplet detecting device comprising:

an jet control circuit section in which ink droplets are jetted from each nozzle of the plurality of nozzle lines; and a control section for performing control such that the same jet start signals are sent in common to the jet control circuit section and the jetting timing of the ink droplets to be jetted from each nozzle of the multiple nozzle lines is synchronized when the jetted state of the ink droplets that are jetted from each nozzle is sequentially detected.

(2) The ink droplet detection device of (1), wherein at the time when the ink droplets have been detected from all the nozzle lines by the beam receiving means before a fixed time has elapsed since the jet start signal was sent to jet control section, the control circuit section sends jet start signals in common to the jet control circuit sections corresponding to the next nozzles for detection in the multiple nozzle lines, and if even after the fixed time has elapsed, ink droplets are not detected from at least one of the nozzle lines by the beam receiving means, after this fixed time has elapsed, the jet start signals are sent in common to the jet control circuit portion corresponding to next detection nozzle of the multiple nozzle lines.

(3) An ink droplet detection device in which ink droplets are detected by disposing detection beams that are formed between the beam radiating means and the beam receiving means so as to cross the advance path of the ink droplets corresponding with multiple nozzle lines comprising multiple nozzles which jet ink droplets, and by determining the shading of the ink droplets that are sequentially jetted from each nozzle using the beam receiving means, said ink droplet detecting device comprising:

a jet control circuit in which ink droplets are jetted from each nozzle of the plurality of nozzle lines;

a control section for sending the jet start signals to the jet control circuit section when the jetted state of the ink droplets that are jetted from each nozzle is sequentially detected;

a determination means for determining whether ink droplets from all of the nozzle lines are detected by the beam receiving means before a fixed time elapses since the jet start signal is sent to the jet control circuit section or if ink droplets are not detected from at least one of the nozzle lines by the beam receiving means even after the fixed time has elapsed, and in the case where the determination means makes one of the above determinations, the control section performs control by sending the jet start signals to the jet control circuit section corresponding to the next nozzle for detection of the multiple nozzle lines and ink droplets are jetted from the nozzles in each nozzle line.

(4) The ink droplet detection device of (3) comprising a non-jetting nozzle specifying means which specifies the non-jetting nozzles wherein, in the case where a determination is made that ink droplets are not detected from at least one nozzle at the determination means, one nozzle at a time sequentially caused to jet ink droplets when this determination is made.

(5) The ink droplet detection device of (4) comprising: a counting means for counting the frequency of the cases in which a determination is made that ink droplets are not detected from at least one nozzle at the determination means; and the non-jetting nozzle specifying specifies a non-jetting nozzle only when the count value from the counting means is within a set value.

(6) The ink droplet detection device of any of Claims (1) to (5), wherein the detection beam is disposed so as to correspond to a plurality of nozzle lines by being received by a plurality of beam receiving means corresponding to one beam radiating means.

The following is a description of the embodiments of this invention.

FIG. 1 is a perspective view of an example of the ink droplet detection means (a droplet detection apparatus). In the drawing, 1 is an ink jet head, and comprises ink jet heads 1*a*, 1*b*, 1*c*, and 1*d* in this embodiment. 2 is a beam radiating means (a beam radiator) and a LED may be used for example. 3 is a beam receiving means (a beam receiver). L is the beam receiving path (light path of detection beam) formed between the beam radiating means 2 and the beam receiving means 3. In this embodiment, the beam radiating means 2 and the beam receiving means 3 are disposed in 4 sets corresponding to the ink jet heads 1*a*, 1*b*, 1*c*, and 1*d* and thus 4 light paths L are formed. 10 is an ink receiving plate for receiving ink droplets jetted at the time of ink droplet detection.

Figure 2:
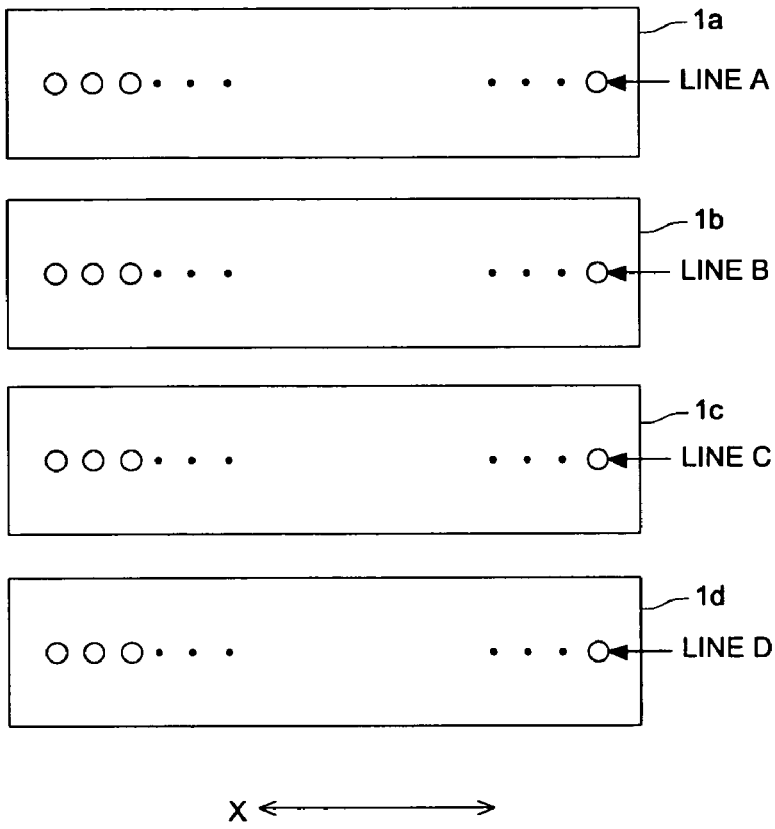
FIG. 2 is an explanatory view showing a preferable aspect of the ink jet head.
Figure 3:
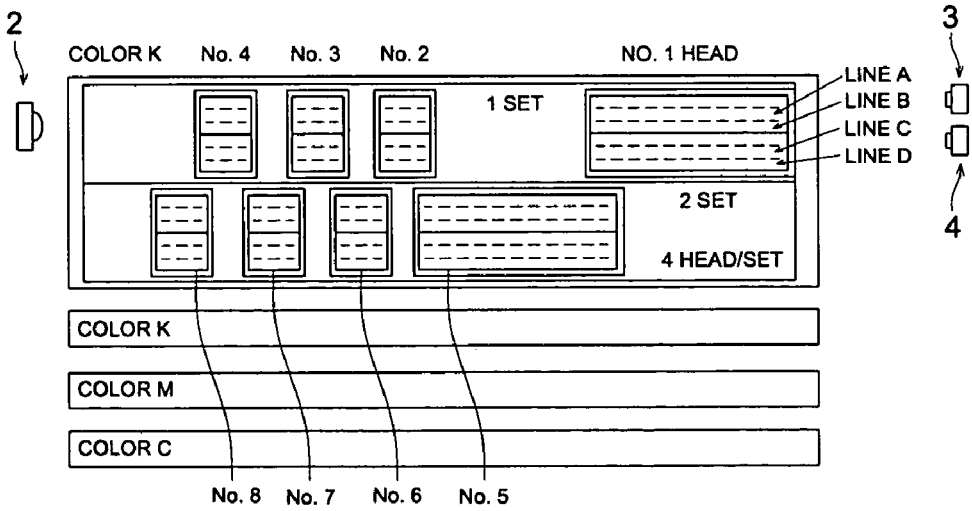
FIG. 3 is an explanatory view showing another preferable aspect of the ink jet head.

The ink jet head which is suitably used in this invention may be one such as that shown in FIG. 2 having a plurality of heads arranged in a line with one nozzle line in the direction x which is parallel to the light path L, or alternatively may be one such as that shown in FIG. 3 which has a plurality of nozzle lines which eject ink droplets arranged on one head.

FIG. 2 is an explanatory drawing of an ink jet head which can be used in FIG. 1 and shows the view from the nozzle side. The ink jet heads 1*a*, 1*b*, 1*c*, and 1*d* have each of the nozzle lines A, B, C and D formed thereon.

Next the ink jet head shown in FIG. 3 will be described in the following. The example in FIG. 3 shows ink jet heads (line heads) having the 4 colors, color K, color Y, color M, and color C.

K will be used as representative example in the following description. No. 1-No. 4 form the first set of heads and No. 5-No. 8 form the second set of heads. In this example one set has four heads.

No. 1 head has four lines of nozzles, line A, line B, line C and line D.

In a line head there are a plurality of nozzles. In the present invention, the line head have more than 500 nozzles, preferably 1000 nozzles.

No. 2 to No. 8 heads also have four lines of nozzles, line A, line B, line C and line D.

The colors Y, M, C, and K are formed in the same manner and have nozzle lines, line A, line B, line C and line D in each line. That is to say, each line head take on the function of ejecting the one of colored ink.

Line A may for example be formed of 256 nozzles×180 dpi.

Figure 4:
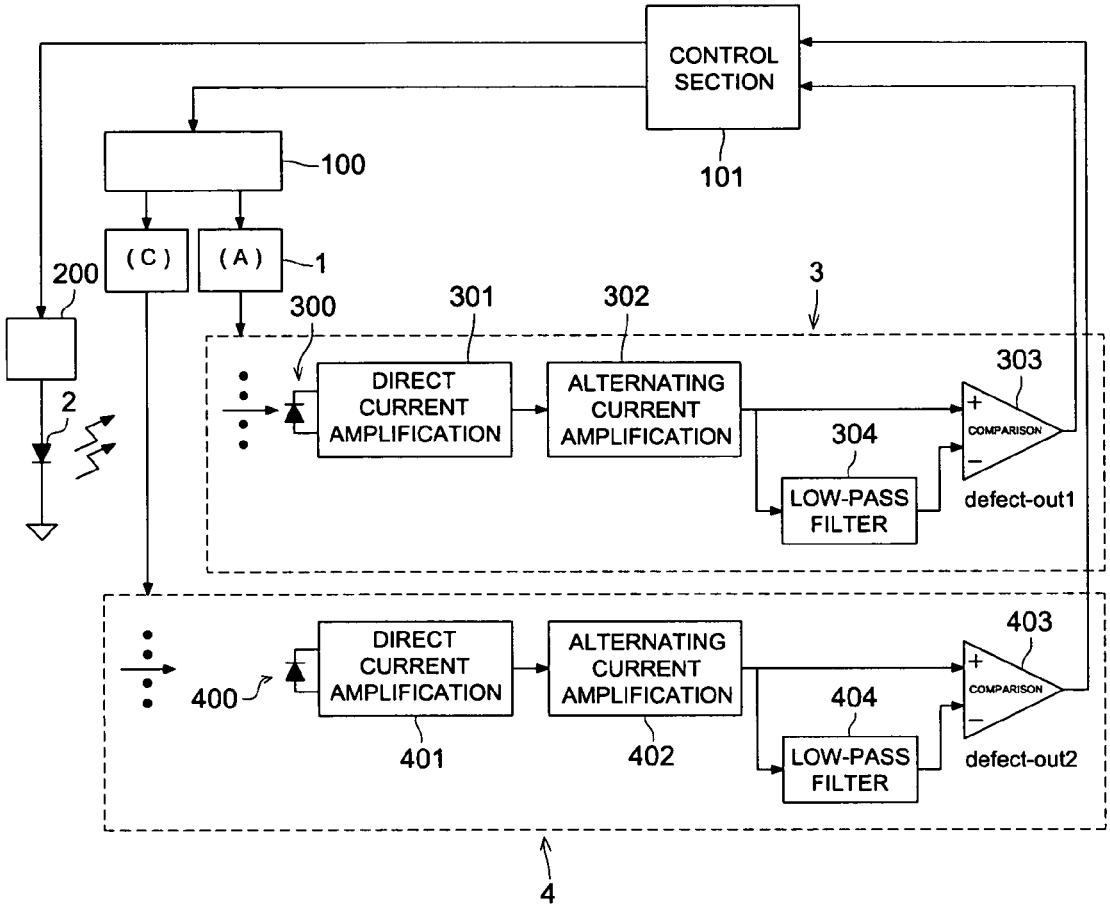
FIG. 4 is a functional block diagram showing a preferred embodiment of this invention.

Next FIG. 4 describes an example of jet control in the case where the head shown in FIG. 3 is used.

FIG. 4 is functional block diagram showing a preferred embodiment of this invention.

FIG. 4 shows the examples ((A) and (C) in the drawings) using the two nozzle lines (line A and line C) of the No. 1 head which is shown by 1, 1.

The ink droplet jetting from the nozzle line A and C is controlled by the same jet start signals (jetting start signals) from the control section 101 being sent to the jet control circuit section 100 and control is performed by the jet control circuit section 100 being driven.

The beam radiating means 2 is disposed at a position in the line direction of nozzle of the nozzle lines A and C where beam radiation is possible. In the example shown in the drawing, the beam radiating means 2 controls beam radiation using the beam radiation driving means 200 and the beam radiation driving means 200 is controlled by the control section 101.

In this embodiment, beam receiving means 3 and 4 are provided for one beam radiating means 2 for ink droplet detection of the nozzle corresponding to the nozzle lines A and C, and the beam receiving means 3 and 4 share one beam radiating means 2. Due to this configuration, error due to variation in the parts of the beam radiating means in the beam receiving means 3 and 4 is less compared to the case where each of the beam receiving means 3 and 4 has a beam radiating means and the stable detection of ink droplets is possible. It is preferably that a plurality of beam receivers are provided corresponding to line heads.

The beam receiving means 3 corresponding to the nozzle of the nozzle line A will be first described in the following.

The beam receiving means 3 has a light receiving element 300, and a photodiode may be used for example as the light receiving element 300. The light amount signals that are received by the photodiode 300 is amplified at the current amplification section 301 and next only the changed portion is amplified at the alternating current amplifying section 302. Next the signal is compared with a reference signal which is generated via the low-pass filter 304 in the comparator 303. In the comparator 303, signal changes which are larger than that of the reference signal is detected.

Next, the beam receiving means 4 corresponding to the nozzles of the nozzle line C is described.

The beam receiving means 4 has a light receiving element 400, and a photodiode may, for example, be used as the light receiving element 400. The light amount signals that are received by the photodiode 400 are amplified at the current amplification section 401 and then only the changed portion is amplified at the alternating current amplifying section 402. Next the signal is compared with a reference signal which is generated via the low-pass filter 404 in the comparator 403. In the comparator 403, signal changes which are larger than that of the reference signal is detected.

Figure 5:
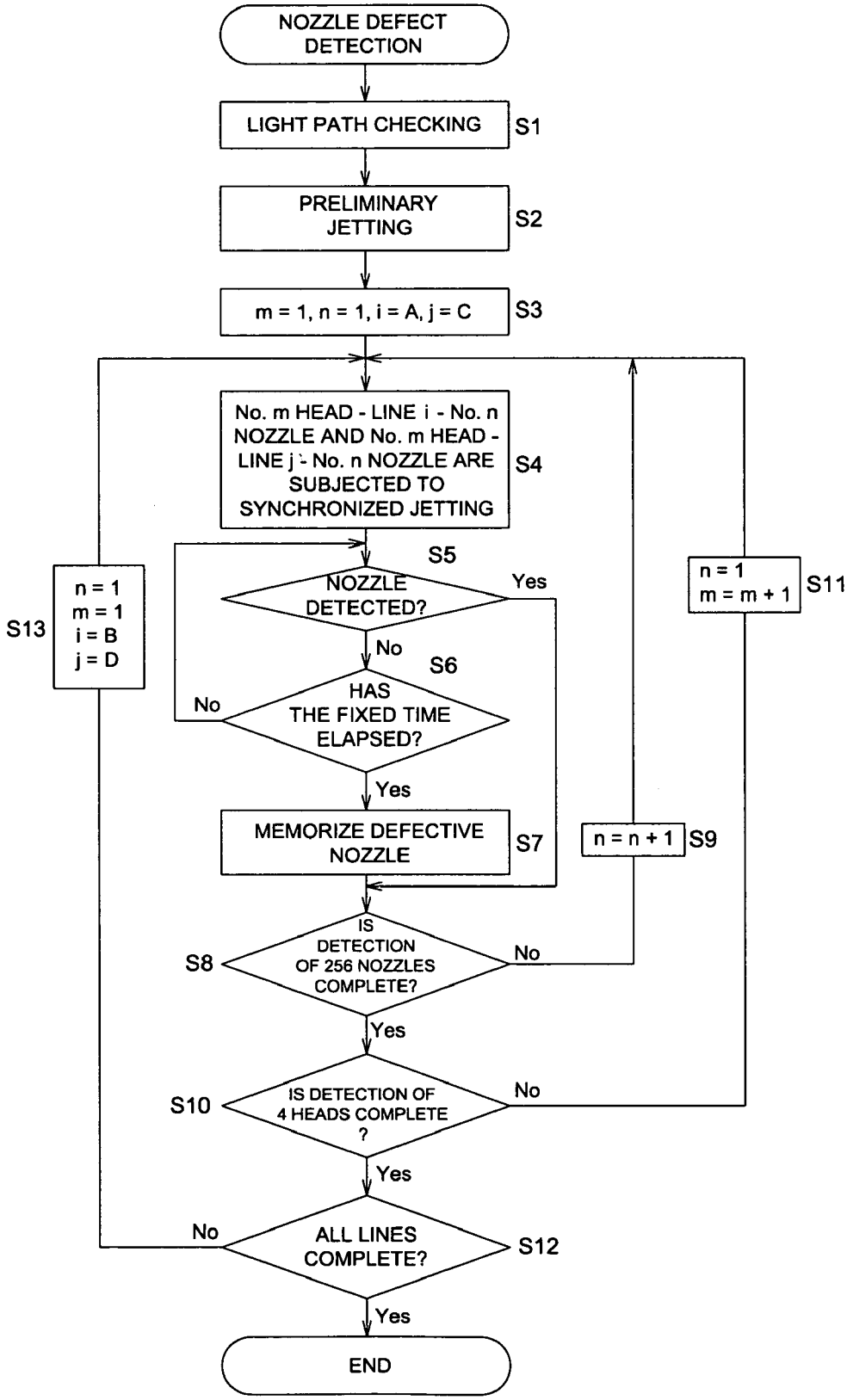
FIG. 5 is a flowchart showing a preferred embodiment of this invention.

Next, an example of the control operation at the time detection of non-jetting nozzles for one color that is performed using the ink droplet detection device of this embodiment is described based on the flowchart in FIG. 5.

The nozzle line for detection of the nozzle inkjet head shown in FIG. 3 is disposed between the beam radiating means 2 and the light receiving elements 300 and 400 so as to be the same as the light path and the light path is checked (S1).

Next the jet control circuit section 100 is driven and controlled by the control section 101 and preliminary jetting is performed prior to conducting detection so that the jetting is carried out favorably and stably (S2). It is to be noted that the timing for ink droplet jetting is performed by controlling the jet control circuit section 100 using the same jet start signals from the control section 101, and the jet control circuit section 100 controls the nozzle lines using the timing of the jet start signals.

Next, given that the head number is m, the nozzle number is n, and the nozzle line is i, j, substitution is done such that m=1, i=A and j=C (S3). That is to say, the following line detection of lines A and C at the No. n nozzle in the No. m head is performed. Line A and Line C are the names of the nozzle lines given as examples of the configuration of the ink jet head shown in FIG. 3.

It is to be noted that after the preliminary jetting, the control section 101 may determine the type of ink that is jetted from the No. 1 head that performs the detection operation first here, or it may be determined in advance.

Next, the control section 101 sends the same jet start signals respectively to the jet control circuit sections 100 such that the jetting of ink droplets from the No. n nozzle of the line i and the No. m head from the No. n nozzle of the line j of the No. m head is synchronized and synchronized jetting is thereby performed (S4). That is to say, the jetting of the nozzles corresponding to line A and line C in FIG. 5 are synchronized by common jet start signal, or in other words, because the setting in S3 is substituted to m=1, n=1, i=A and j=C, ink droplets can be jetted from corresponding nozzles. The ink droplets that are jetted in synchrony from each of the nozzles in nozzle lines A and C are multiple continuous droplets.

The ink droplets jetted from the No. 1 nozzle pass the light path formed between the beam radiating means 2 and the light receiving elements 300 and 400. Due to the passage of the ink droplets a portion of the light path in the light receiving elements 300 and 400 is shielded and the received light signal amount is temporarily reduced. In the beam receiving means 3, the light amount signal received by the light receiving element 300 is amplified at the current amplification section 301 and next only the changed portion is amplified at the alternating current amplifying section 302 and a signal for comparison with a reference signal is obtained.

Next a detection is made as to whether or not there is defect-out signal output from the beam receiving means 3 (S5). If a signal change that is larger than the reference signal at the comparator 303 is detected, this signal is output. That is to say, the ink droplets from the No. 1 nozzle are continuously jetted, and when one of the ink droplets passes on the light path, and a detection is made that there is a signal change portion that is larger than the reference signal in the comparator 303, and a defect-out signal is output to the control section when detected.

Figure 6:
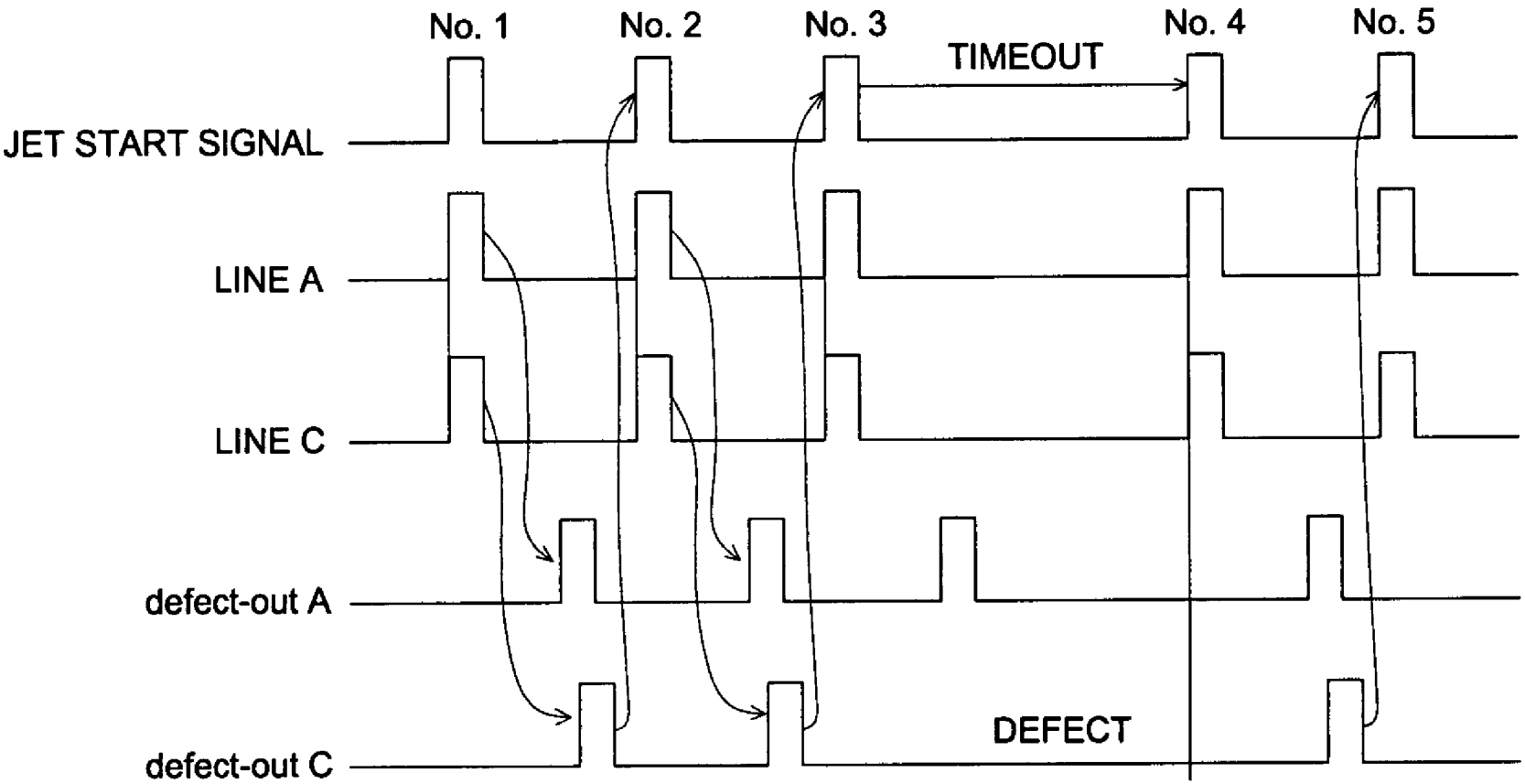
FIG. 6 is a timing chart showing a preferred embodiment of this invention.

An example of this signal is shown in FIG. 6. FIG. 6 shows the timing chart for ink droplet jetting and detection in the No. 1 nozzle to the No. 5 nozzle of the nozzle lines line A and line C. In the example shown, when jetting of the No. 1 head of line A and Line C are synchronized with the same jet start signals (the same ejecting start signals) from the control section 101, when the passage of the ink droplet that is jetted is detected by the beam receiving means 3 and 4, the defect-out signal is generated and sent to each of the control sections 101.

In the timing chart example shown, the control section 101 receives the various signals, and when the signals are received, the same jet start signals for the next nozzle are sent to the respective jet control circuit sections 100 and the process for synchronized jetting from the No. 2 nozzles of line A and line C is performed. It is preferably that the controller sends the same ejecting start signals at the time the controller receives the latest defect-out signal.

Also, in the example of the timing chart shown, shows the case in which passage of the ink droplets jetted from the No. 3 nozzle of line C is not detected by the beam receiving means 4. That is to say, this is the case where the presence of a large signal change portion was not detected at the beam receiving means 4, and in this case, defect-out signals are not output to the control section 101. At the time when the jet start signal is sent to the jet control circuit section 100, the control section 101 monitors the timer which starts and in the case where the defect-out signal from the beam receiving means 3 and 4 is not output even after a fixed time has elapsed (time out), the nozzle is determined to be a non-jetting nozzle, and at that point, the same jet start signal is sent to each of the jet control circuit sections 100 and synchronized jetting from the nozzles in line A and line C is performed.

It is to be noted that this fixed time is set to a time that is sufficient for the ink droplets jetted from the nozzle to pass on the light path after the jet start signal is sent to the jet control circuit section 100.

Next returning to the flowchart in FIG. 5 shows that the control section 101 monitors the passage of the fixed time (S6), and in the case where jetting from a nozzle of any one of the nozzle lines, line A or line C is not detected even after a fixed time has elapsed, a determination is made that there is a non-jetting nozzle (called defective nozzle) in one of the nozzle lines, and non-jetting nozzle number is stored (S7). For example, in the case of the timing chart shown in FIG. 6, because ink droplets were not detected even after a fixed time elapsed (timeout), the No. 3 nozzle of line C is determined to be a non-jetting nozzle. In this case also, the head number and the like may be stored, or sufficient information for specifying the non-jetting nozzle may be stored.

In addition, in the case where jetting from both nozzles is detected, or in other words, when the control section 101 receives defect-out signals from the both nozzle lines before the fixed time elapses, the processing of S7 is not performed, and at that point in time, the same jet start signals for the next nozzles are sent to each of the jet control circuit sections 100.

Next, a determination is made as to whether detection of all the nozzles in the nozzle lines A and C of the No. m head is complete (S8). For example, because the number of nozzles in one line of one head is 256, a determination is made as to whether detection of the 256 nozzles was complete, and in the case where the 256 nozzles are not complete (NO in S8), 1 is added to the nozzle number n (S9) and the process of S4 is returned to.

Next, in the case where detection of all the nozzles in the nozzle lines A and C of the No. m head is complete (YES in S8), a determination is made as to whether detection of all of the ink jet heads (also simply called heads) is complete (S10).

For example, in FIG. 3, the number of heads is 4 (No. 1 -No. 4), and thus a determination is made as to whether all four heads have been complete, in the case where the four heads are not complete (NO in S10), the nozzle number n is returned to the start value (n=1), and 1 is added to the head number m (S11), and the process of S4 is returned to.

Next, a determination is made as to whether all the nozzle lines of the heads comprising the ink jet head have been detected (S12). If a determination is made as to whether detection of four lines is complete determines that four lines are not complete (NO in S12), the nozzle number n is returned to the start value (n=1), and the head number m is returned to the start value (m=1), B is substituted by i, and D is substituted by j, and the process of S4 is returned to.

When all processing is complete, (YES in S12) the processing ends.

In the above process flow, the time taken until the determinations from S4 to S8 become YES is 128 msec. Furthermore, the time taken until the determination in S10 becomes YES is 128 msec×4 heads=approximately 0.5 seconds because it is four times the time taken for the determination to become YES from S4 to S8. Also, the time it takes for processing for one color to be complete is about 0.5 sec times 2 which is approximately one second because the time taken until the determination in S10 becomes YES is for two lines, and first the jetting is carried out for 2 lines, line A and line C, and all together there are four lines A-D. In other words, the time taken for one color processing to be complete is approximately 1.0 second.

In addition, because the jet control circuit sections 100 are driven by the same jet start signals, each of the nozzle lines that carry out detection are controlled such that jetting of ink droplets from each is synchronized, and thus there is no need to independently control each nozzle line, and thus the circuit configuration for jet control is simplified.

One embodiment of this invention was described above, but this invention is not to be limited by the above, and the following aspects may also be employed.

In the above description, the case of color K is described, but the colors M, Y, and C also are based on the same processing system and detection of non-jetting nozzles can be performed for the color K and other colors simultaneously or alternatively, detection of non-jetting nozzles is performed separately for each color one after the other.

Also in the above aspect, detection of lines on the same head was performed, but the same nozzle number may be synchronously detected on one head and other heads.

Furthermore, in the above aspect, the jetting of ink droplets from the previous nozzle is confirmed and then the jet start signal for the next nozzle is generated. However another favorable aspect is one in which the jet start signal from the control section 101 is set at the timeout time from the start, and synchronized jetting can be performed with a timing that coincides with the same jet start signal without consideration of whether there is ink droplet jetting confirmation.

In addition, in the configuration shown in FIG. 4, only one beam irradiating means 2 is used, but the configuration is not limited thereto, a number corresponding to the number of beam receiving means may be employed.

The configuration of the ink jet head may also be used in the ink jet head shown in FIG. 2.

In the ink jet head shown in FIG. 3, the configuration of the second set is the same as the configuration of the first set, but because each set is independent, the two sets may advance simultaneously or may advance separately.

The nozzle line for synchronous jetting that is to be detected is limited to two lines in the description above, but it may have three or more lines. If there are three lines or more, further reduction of the additional detection time and simplification of the circuit configuration for jet control becomes possible.

Next another embodiment of this invention will be described based on FIG. 7. In the following the structures which are different from the aspect shown in FIG. 2 and the description of the structural parts which are the same will be employed and thus description thereof is omitted.

Figure 7:
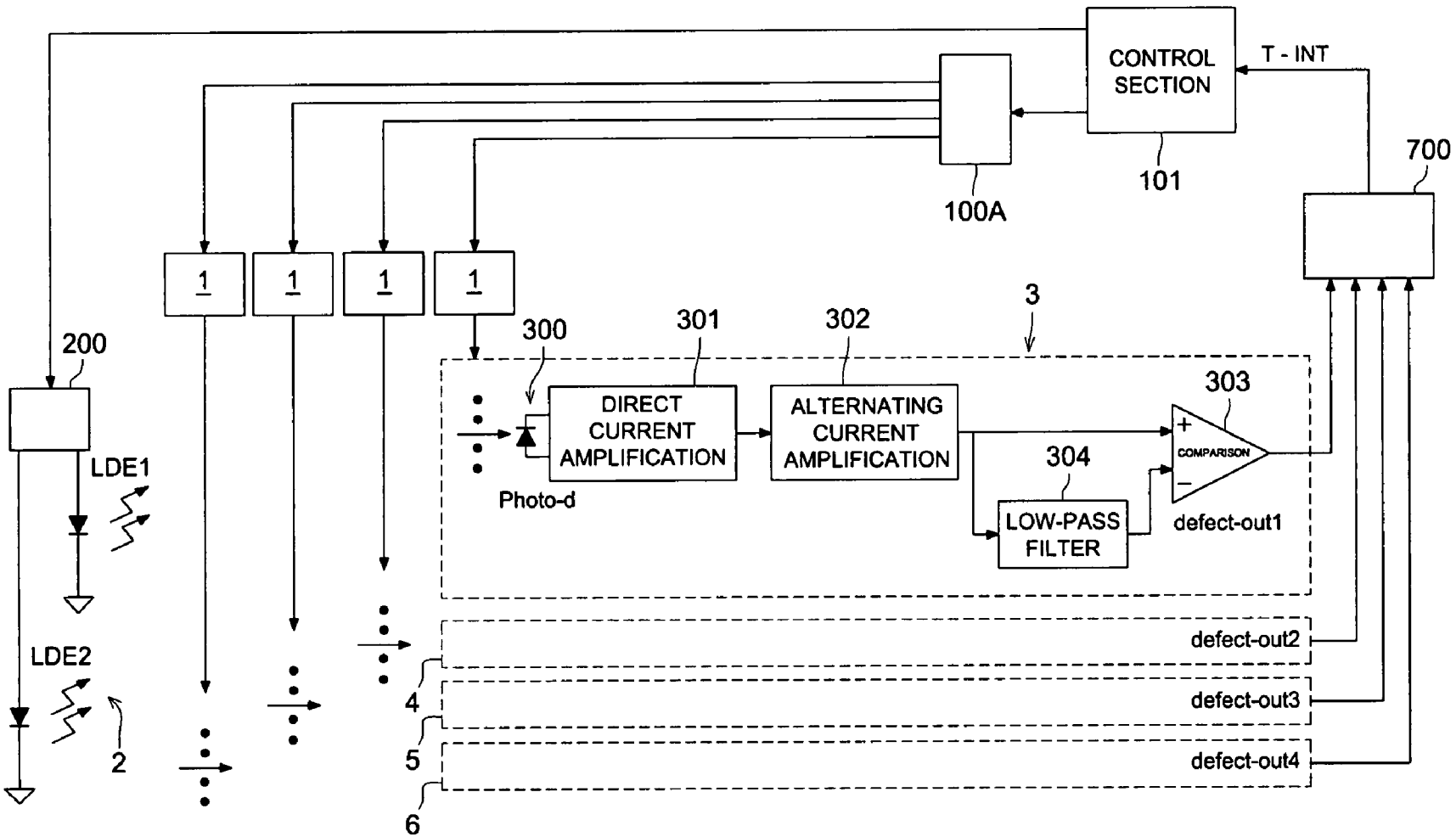
FIG. 7 is a functional block diagram showing another preferable embodiment of this invention.

One feature of the aspect shown in FIG. 7 is that it comprises the ink jet head 1, 1 . . . , and the ink jet head 1, 1 . . . is controlled only by one jet control circuit section 100A. Thus the jet control circuit section is simplified and lower in cost.

Two beam radiating means 2 (LED 1 and LED 2) are included which are driven and controlled by a common beam radiating driving means 200. The low number of drive circuits contributes to the low cost of the device.

The beam receiving means 3, 4, 5, and 6 are provided in accordance with the number of ink jet heads (or the number of nozzle lines). The signals from the four comparators which each of the beam receiving means 3, 4, 5, and 6 pass through one logic integrated circuit 700.

In this aspect, corresponding jetting of the nozzles in the plurality of nozzle lines may be performed based on the common jet start signals or may be performed by separate jet start signals. That is to say, this is an aspect in which high speed line detection can be done due to the presence of the logic integrated circuit 700. In the flowchart which is given in the aspect above may employ parallel jetting rather than synchronized jetting.

The logic integrated circuit 700 waits until defect-out signals are output from the beam receiving means 3, 4, 5, and 6 and in the case where defect-out signals are output from all of the beam receiving means 3, 4, 5, and 6, at that point, signals (T-INT signals) are output to the control section 101 (a controller). The control section 101 sends jet start signals for the next nozzle to the jet control circuit section 100A (an ejecting control circuit) at the point when the signal is received from the logic integrated circuit 700 and jetting of the next ink droplets are respectively carried out. Thus, each nozzle line jets the ink droplets from the next nozzles with synchronized timing. As a result, the control section 101 has a simplified circuit configuration for processing of received signals since only a single signal from the logic integrated circuit 700 is received.

Also, in the case where defect-out signals ink droplets are not detected from at least one beam receiving means among the beam receiving means 3, 4, 5, and 6, the signals (T-INT signals) are not output to the control section 101. That is to say, the logic integrated circuit 700 outputs signals to the control section 101 only in the case where after the jet start signals are output, ink droplets are detected for all the nozzle lines by the beam receiving means 3, 4, 5, and 6. As a result, the control section 100 determines that all of the nozzles of the nozzle line are normal.

Here, the control section 100 monitors the timer which starts at the point where the jet start signals are sent to the jet control circuit section 100A, and in the case where signals from the logic integrated circuit 700 are not output even after a fixed time has elapsed (time out), it is determined that ink droplets are not detected from a nozzle of at least one of the nozzle lines, or in other words, a nozzle of at least one of the nozzle lines is determined to be a non-jetting nozzle. Thus in this embodiment, because of the control section 100 and the logic integrated circuit 700, a determination can be made as to whether ink droplets have been detected for all the nozzle lines by the beam receiving means 3, 4, 5, and 6 before a fixed time elapses after the control section 101 sends jet start signals to the jet control circuit section 100A, or whether ink droplets are not detected for at least one of the nozzle lines by the beam receiving means 3, 4, 5, and 6.

It is to be noted that this fixed time is set to a time that is sufficient for the ink droplets jetted from the nozzle to pass on the light path after the jet start signal is sent to the jet control circuit section 100A.

In the logic integrated circuit 700 described above, the signals (T-INT signals) are output to the control section 101 only in the case where ink droplets are detected for all of the nozzle lines, but in the logic integrated circuit 700, a determination is made as to whether ink droplets have been detected for all the nozzle lines, or whether ink droplets were not detected for at least one of the nozzle lines, and the result of this determination may be output to the control section 101. In this case, in the logic integrated circuit 700, the fixed time from the point when the jet start signals are sent to the jet control circuit section 100A is monitored by the timer, and in the case where the defect out signals from the beam receiving means 3, 4, 5, and 6 are output before the fixed time elapses, and ink droplets are detected at all the nozzle lines, a signal indicating "detection" (such as signal "1" is output, and in the case where even after the fixed time has elapsed, ink droplets are not detected for at least one of the nozzle lines, a signal indicating "non-jetting nozzle" (such as signal "0") is output and each of the different signals are output to the control section 101.

However, in these embodiments which use the logic integrated circuit 700, because only one of the determination as to whether ink droplets have been detected for all the nozzle lines and whether ink droplets are not detected for at least one of the nozzle lines can be made, even if there is a non-jetting nozzle, this nozzle cannot be identified as which nozzle in which nozzle line.

As a result, in the case where the control section 101 determines that there is a non-jetting nozzle, it is preferable that after detection of all of the nozzles is complete, each of the nozzles are made to jet ink droplets one at a time in sequential order when the determination is made that there is a non-jetting nozzle in order to specify the non-jetting nozzle. In the case where a determination is made that there is at least one non-jetting nozzle when jetting is done from each of the No. 5 nozzles in each nozzle line for example, in order to jet from all of the same nozzle numbers from each nozzle line, ink droplets are successively jetted one by one from the No. 5 nozzle of each nozzle line, and by checking whether there is ink droplet jetting for each of the nozzles, the nozzle line which has the defective nozzle can be specified.

Normally the number of non-jetting nozzles present is extremely low with respect to the number of normal nozzle and thus, as is the case in this aspect, if a second detection is performed afterwards in order to specify the non-jetting nozzles, there is the effect that detection time is not wasted.

It is also preferable that in the case where the results of performing detection for each of the nozzle lines indicate that the number of non-jetting nozzles included in the nozzle line exceeds a fixed value, the operation of specifying the non-jetting nozzles described above is not performed. In the case where the number of non-jetting nozzles included in one nozzle line is an extremely small number such as in the range 1-2, it is possible to control deterioration in image quality by performing electrical processes such that the non-jetting nozzles are compensated for by the other nozzles, and loss of time for maintenance work and the like is controlled. However, in the case where the number of non-jetting nozzles included in one nozzle line is very large, controlling image quality using electrical processes is difficult, and because it is necessary to perform maintenance operations such as ink suction and the like for the nozzle line, or for the head having that nozzle line, there is no need to take the trouble to specify the non-jetting nozzle, and detection time for doing unnecessary specifying is not lost.

The determination as to whether the number of non-jetting nozzles exceeds a fixed value is done by providing a counter (not shown) which counts the frequency of occurrence of non-jetting nozzles by being connected to the control section 101 and the logic integrated circuit 700 at the inside or outside of the control section 101 and the logic integrated circuit 700. The threshold value for the frequency of appearance of the non-jetting nozzles is set and a determination is made as to whether the nozzle is to be specified as a non-jetting nozzle.

Preferred embodiments of this invention have been described above, but the embodiments of this invention are not limited to those above, and for example, if the light emitting element has two light receiving elements, a prism may be used for extending the light path.

Furthermore, in the description above, a common beam radiating means is used for a plurality of beam receiving means in order to simplify the configuration, but it is of course possible for one beam radiating means to be provided for each beam receiving means.

The description above is for an ink jet recording device for performing recording by jetting ink droplets from a nozzle which has an ink jet head onto a recording medium, but the ink droplet detection device of this invention may be more widely applied to any case in which the passage of ink droplets jetted from a nozzle is detected.

What is claimed is:

1. An ink droplet detection apparatus comprising:

a plurality of nozzle lines each containing multiple nozzles which eject ink droplets;

a beam radiator which radiates a detection beam so as to cross a path of the ejected ink droplets and which forms a light path of the detection beam so as to be along at least two of the nozzle lines to be detected;

at least two beam receivers corresponding to the nozzle lines being detected for receiving the detection beam radiated from the beam radiator and detecting the ink droplets ejected from each nozzle by determining whether the ink droplets ejected from each nozzle intercept the light path;

an ejecting control circuit which controls ejection of the ink droplets from the nozzles; and a controller for controlling the ejecting control circuit by sending the ejecting control circuit first same ejecting start signals for each of the nozzle lines being detected so that an ejecting timing of the ink droplets to be ejected from each first nozzle of the plurality of the nozzle lines being detected is synchronized;

wherein the controller sends the ejecting control circuit second same ejecting start signals for each of the nozzle lines being detected so that an ejecting timing of the ink droplets to be ejected from each second nozzle of the plurality of the nozzle lines being detected is synchronized at a time the ink droplets are detected from all the nozzle lines by the beam receivers before a fixed time has elapsed after the first same ejecting start signals were sent to the ejecting control circuit.

2. The ink droplet apparatus of claim 1, wherein the beam radiator comprises a single beam radiator, and wherein the detection beam is disposed so as to correspond to a plurality of the nozzle lines by being received by a plurality of the beam receivers corresponding to the single beam radiator.

3. An ink droplet detection apparatus comprising:

a plurality of nozzle lines each containing multiple nozzles which eject ink droplets;

a beam radiator which radiates a detection beam so as to cross a path of the ejected ink droplets and which forms a light path of the detection beam so as to be along at least two of the nozzle lines to be detected;

at least two beam receivers corresponding to the nozzle lines being detected for receiving the detection beam radiated from the beam radiator and detecting the ink droplets ejected from each nozzle by determining whether the ink droplets ejected from each nozzle intercept the light path;

an ejecting control circuit which controls ejection of the ink droplets from the nozzles; and a controller for controlling the ejecting control circuit by sending the ejecting control circuit first same ejecting start signals for each of the nozzle lines being detected so that an ejecting timing of the ink droplets to be ejected from each first nozzle of the plurality of the nozzle lines being detected is synchronized;

wherein the controller sends the ejecting control circuit second same ejecting start signals for each of the nozzle lines being detected so that an ejecting timing of the ink droplets to be ejected from each second nozzle of the plurality of the nozzle lines being detected is synchronized after a fixed time has elapsed since the first same ejecting start signals were sent to the ejecting control circuit even if the ink droplets are not detected from all of the nozzle lines by the beam receivers.

4. The ink droplet apparatus of claim 3, wherein the beam radiator comprises a single beam radiator, and wherein the detection beam is disposed so as to correspond to a plurality of the nozzle lines by being received by a plurality of the beam receivers corresponding to the single beam radiator.

5. An ink droplet detection apparatus comprising:

a plurality of nozzle lines each containing multiple nozzles which eject ink droplets;

a beam radiator which radiates a detection beam so as to cross a path of the ejected ink droplets and which forms a light path of the detection beam so as to be along at least two of the nozzle lines to be detected;

at least two beam receivers corresponding to the nozzle lines being detected for receiving the detection beam radiated from the beam radiator and detecting the ink droplets ejected from each nozzle by determining whether the ink droplets ejected from each nozzle intercept the light path;

an ejecting control circuit which controls ejection of the ink droplets from the nozzles;

a controller for controlling the ejecting control circuit by sending the ejecting control circuit first same ejecting start signals for each of the nozzle lines being detected so that an ejecting timing of the ink droplets to be ejected from each first nozzle of the plurality of the nozzle lines being detected is synchronized; and a determination device which determines: (i) a first case when the ink droplets are detected from all the nozzle lines by the beam receivers before a fixed time has elapsed after the first same ejecting start signals were sent to the ejecting control circuit, and (ii) a second case when the ink droplets are not detected from all the nozzle lines by the beam receivers even if the fixed time has elapsed since the first same ejecting start signals were sent to the ejecting control circuit, and wherein the controller sends the ejecting control circuit second same ejecting start signals for each of the nozzle lines being detected so that an ejecting timing of the ink droplets to be ejected from each second nozzle of the plurality of the nozzle lines being detected is synchronized when the determination device determines the first case or the second case.

6. The ink droplet detection apparatus of claim 5, further comprising:

a nonejecting nozzle specifying device which specifies nonejecting nozzles, based on a detection of each nozzle one by one.

7. The ink droplet detection apparatus of claim 6, further comprising:

a counter which counts a frequency of the second case in which the determination is made that the ink droplets are not detected from at least one nozzle at the determination device, wherein the nonejecting nozzle specifying device specifies a nonejecting nozzle only when a count value from the counter is within a predetermined range.

8. The ink droplet apparatus of claim 5, wherein the beam radiator comprises a single beam radiator, and wherein the detection beam is disposed so as to correspond to a plurality of the nozzle lines by being received by a plurality of the beam receivers corresponding to the single beam radiator.

* * * * *

UNITED STATES PATENT AND TRADEMARK OFFICE

CERTIFICATE OF CORRECTION

PATENT NO. : 7,621,617 B2
APPLICATION NO. : 11/408262
DATED : November 24, 2009
INVENTOR(S) : Hiroaki Arakawa It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 108 days.

Signed and Sealed this

Twenty-sixth Day of October, 2010

David J. Kappos

David J. Kappos
*Director of the United States Patent and Trademark Office*